United States Patent [19]

Dassler

[11] 4,100,685

[45] Jul. 18, 1978

[54] SPORTS SHOE

[76] Inventor: Adolf Dassler, Am Bahnhof, D-8522 Herzogenaurach, Fed. Rep. of Germany

[21] Appl. No.: 761,057

[22] Filed: Jan. 21, 1977

[30] Foreign Application Priority Data

Jan. 22, 1976 [DE] Fed. Rep. of Germany ..... 2602310

[51] Int. Cl.[2] ..... A43B 7/06

[52] U.S. Cl. ..... 36/3 B

[58] Field of Search ..... 36/3 R, 3 A, 3 B, 31, 36/30 R, 9 R, 10

[56] References Cited

U.S. PATENT DOCUMENTS

| | | | |
|---|---|---|---|
| 2,884,716 | 5/1959 | Shelare et al. | 36/3 R |
| 3,264,761 | 8/1966 | Johnson | 36/3 A |
| 3,310,887 | 3/1967 | Stokis | 36/3 R |
| 3,402,484 | 9/1968 | Brutting | 36/31 |
| 3,627,567 | 12/1971 | Tensho | 36/3 A |
| 4,000,566 | 1/1977 | Famolare | 36/3 B |

*Primary Examiner*—Patrick D. Lawson

[57] ABSTRACT

A sports shoe, particularly for tennis, has a flexible plastics outsole through which extend venting channels which open, on the interior of the shoe, in the region of a wearer's toes and forwardly of the ball of the foot. Channels can be provided through the bottom of the sole to terminate beneath the hollows of the toes and/or through a rim of the sole at the front of the shoe. In addition, an air-permeable toe part and tongue can be provided further to assist air movement through the shoe in use.

14 Claims, 3 Drawing Figures

SPORTS SHOE

The present invention relates to a sports shoe, in particular, though not exclusively, a tennis shoe.

The problem of the internal venting of sports shoes has received the attention of shoe manufacturers for a considerable time, since, especially in tennis shoes, the heat developed by the foot is considerable, because of the exertion involved in the sport, and heat is also generated in the plastic outsole because of the constant working to which the material is subjected during the rolling movement of the foot (that is to say, the shift in weight from the heel to the toes), and as a result of the friction which occurs. Particularly in the case of sports shoes which are intended for use on hard surfaces, for example tennis shoes, and which therefore have a relatively thick and soft outsole, the unavoidable heat insulating capacity of the outsoles leads to a heat build-up which causes heavy perspiration on the part of the wearer. Apart from the fact that this perspiration detracts from the wearer's comfort and encourages foot ailments, the perspiration severly attacks, and prematurely destroys, the material of the sports shoe upper whether this be leather or a textile fabric.

There has, therefore, been no lack of proposals for supplying air to the foot through the upper and through the sole, in order to reduce the generation of heat, and the resulting perspiration. Thus it has long been customary to provide one or more venting orifices on the upper at the instep, and to perforate the vamp, in order to permit access of air to the foot. However, experience has shown that this type of venting is substantially ineffective. It is also already known to provide venting orifices on the lateral rim of the sole which are in communication with venting channels in the sole and sock lining, and which are intended to supply air to the sole of the foot through orifices terminating on the upper face of the sock lining. These and similar proposals which have the object of cooling those regions of the sole of the foot which experience relatively great stresses have, however, not provided any genuinely acceptable solution to the problem.

According to the present invention there is provided a sports shoe having a flexible plastics outsole in which are provided venting channels extending between the exterior and interior of the shoe, the channels opening at the interior of the shoe in the region of the toes of a wearer and forwardly of the ball of the foot.

The channels may open, at the interior of the shoe, along a line which extends beneath the hollows of the toes, between the ball of the foot and the balls of the toes, of a wearer.

Alternatively, or additionally, the, or further venting channels may be provided in a rim of the sole at the toe end and terminate, on the interior of the shoe, above the insole and any sock lining which may be provided.

The invention is more effective than prior proposals in reducing perspiration and at least to a certain degree, permits a flow of air into the interior of the shoe.

It is now appreciated that a potential direct supply of air to those regions of the foot which are in close contact with the corresponding parts of the shoe, and which are as a rule also subjected to the greatest stress, is of no value. The reason is that the orifices of the air supply channels on the inside of the shoe are effectively closed by the foot resting against them during use. This particularly applies to the region of the ball of the foot, where most heat is generated, and to the region of the instep because when a shoe is put on and laced up it is the wearer's specific objective that the shoe should surround the foot as tightly as possible. Furthermore, it is now clear that no significant supply of air is possible in the remaining regions of the sole on which the foot rests. In contrast, with the invention, it is possible acually to introduce air into the interior of the shoe since the venting channels on the inside of the shoe are constantly open. Also, because, in contrast to the ball of the foot, the toes execute movement relative to the shoe, even in the most tightly fitting shoes, during the rolling movement of the foot, a previously unattained active assistance to air flow through the venting channels is achieved. Air entering the shoe becomes saturated with moisture and can actually be forced out again through the venting channels and thus remove moisture. Since the toe region can be cooled effeciently by this measure, heat is also extracted indirectly from the ball region, so that a wider cooling effect is achieved, and these principles apply with both the alternative arrangements of venting channels. Added advantage is obtained if both arrangements of channels are employed, in that the channels through the rim increase the venting action of the venting channels through the sole quite considerably, because they provide the possibility of flow-through, which in turn is assisted by the toe movement mentioned. Obviously, the slight compression which occurs at the front of the shoe during this movement also assists this flow.

A further optional measure which permits an increase in the cooling effect is to construct the toe part of the shoe upper, and the tongue, of a highly air-permeable fabric, suitably a net fabric. Since the shoe normally rests firmly against the foot at the instep, that is to say in the region of the tongue, no air flow normally takes place there. However, with the provision of a highly air-permeable fabric, there is a possibility of the perspiration formed there evaporating. In the toe region, on the other hand, the use of such a fabric allows the further possibility of through flow of the air which enters through either or both sets of venting channels. Accordingly, the combination of the three venting measures described ensures that at least some of the moisture formed on the foot in use is genuinely transported out of the shoe.

The effect of the air-permeable fabric in the toe part and in the tongue can be further enhanced by using a net fabric in which two covering layers are joined to one another, and kept spaced apart, by fabric loops. This provides a highly permeable interspace in the actual fabric, in which interspace air flow can take place to a certain extent.

Experiments with sports shoes of the invention, in which both sets of venting channels and a highly air-permeable fabric in the toe region and at the tongue have been provided, have shown that these measures genuinely result in a substantially greater venting of the interior of the shoe, and removal of heat resulting therefrom, than that hitherto achievable.

Since, when playing tennis, the rolling movement of the foot is particularly pronounced and results in the upper standing away somewhat from the foot in the waist region of the shoe and below the ankle some venting takes place anyway at the sides of the foot. Special venting measures are therefore not of such essential importance at this part of the shoe as they are in the front region of the shoe, especially in the sole region.

The invention will be more clearly understood from the following description which is given, by way of example only, with reference to the accompanying drawings in which.

Figure 1:
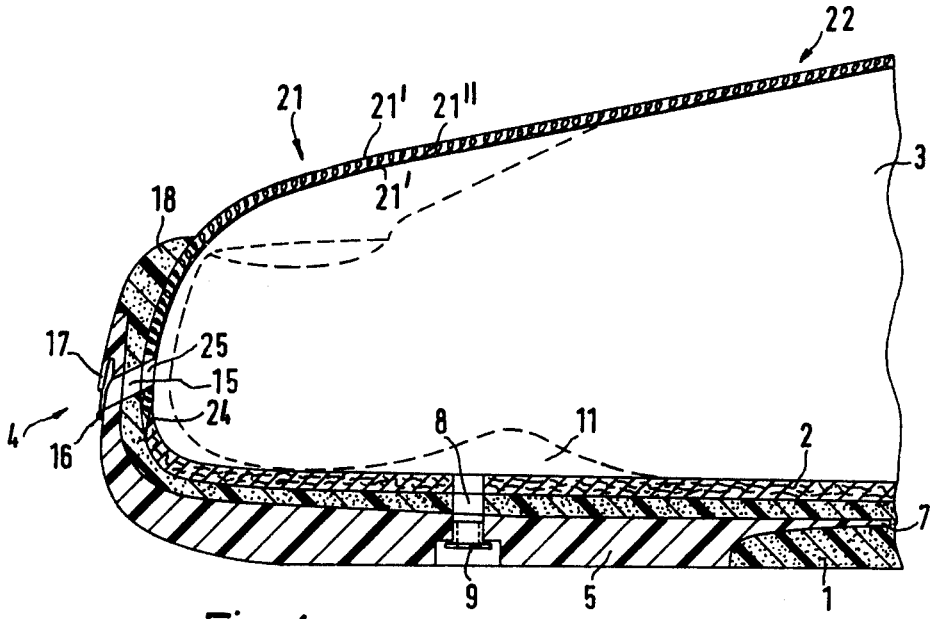
FIG. 1 shows a longitudinal section along line I—I in FIG. 2, through the front part of a sports shoe according to the invention.

The sports shoe shown in the drawings is a tennis shoe with a so-called "shell" sole 1, 5 of polyurethane foam which peripherally extends, by means of a rim 4, over the edge of an upper 3 which is joined to an insole 2. The shell sole 1 is advantageously joined to the upper 3 by direct moulding-on of the shell sole.

Figure 3:
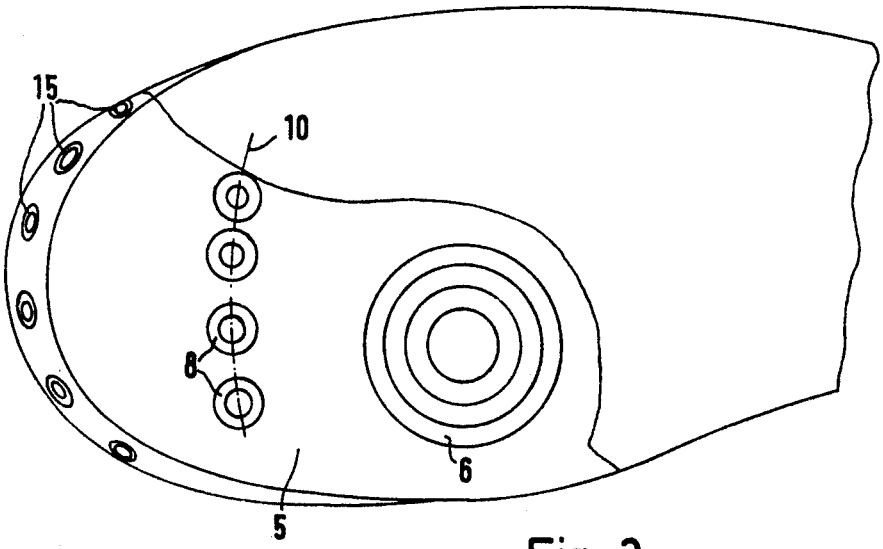
FIG. 3 shows a view from below of the front part of the shoe of FIGS. 1 and 2, from which the position of the venting orifices may be seen.

As may be seen in particular from FIG. 3, the ball region and toe region of the shell sole is formed by a moulded part 5 of the sole which is of a particularly wear-resistant plastics material, for example a cross linked polyurethane, trade name Vulkollan, which, upon formation of the shell sole is directly engaged with the polyurethane foam being cast to form the main part 1 of the sole and is thereby bonded into the shell sole. The moulded part 5 has, in the region of the inner ball of the foot, a locally restricted ring profiling 6 (FIG. 3) and is provided elsewhere with any desired profiling or surface texture, not shown in more detail, which advantageously matches that of the main part 1. At its rear end, the moulded part 5 thins out at a tapering rear part 7, in order that there should not be a sudden unevenness in properties of the sole resulting from the transition from the material of the part 5 to the material of the main part 1 of the sole.

The moulded part 5 is penetrated by four venting channels 8, aligned with corresponding orifices in the insole 2 and in any sock lining which is present (none is shown). The orifices in the sock lining can be dispensed with if the lining consists of a substantially air-permeable material, for example a net material, as will be explained in more detail below. The venting channels 8 are stepped, so that they each have an outer part of larger diameter. Each contains a sieve or filter insert 9 which prevents the penetration of dirt particles into the interior of the shoe without detracting from the desired ventilation. As is shown in FIG. 3, the venting channels 8 are arranged along a line 10 which runs under the toe hollows 11 of a user (FIG. 1), that is to say between the ball of the user's foot and balls of his toes. The distance of the line 10 from the front edge of the shoe naturally varies with the size of the shoe and to a slight extent also with the particular shape of the shoe chosen. Moreover, this distance, as shown in FIG. 3, is not constant but decreases towards the outside of the shoe and foot in accordance with the usual decrease in the length of the toes from the large toe to the small toe. As an example, in the case of shoe size 7, the maximum distance of the line 10 from the front edge of the shoe may be about 6 cm.

The moulded part 5 also forms a part of the rim 4 of the sole. In the rim, at the front 6 of the shoe, there are provided front venting channels 15 which slope upwards at an angle from an outer orifice and terminate in the interior of the shoe, above the insole 2. As shown, channels 15 are in part of the rim 4 defined by the moulded part 5 of the sole. The outer orifices of the venting channels 15 are each surrounded by a ring-shaped bead 16 and are, furthermore, partially covered by a thin lip 17 which is moulded on to the upper rim of the moulded part 5. As a result of the combination of these three measures, namely an upward inclination to the interior, a bead around the outer orifice and a partial covering by the lip 17, which are preferably all provided though this is not essential, the entry of dirt into the front venting channels 15 is restricted.

Above the upper rim of the moulded part 5, the rim 4 terminates in a scuffing bead 18 which protects the cap of the shoe against premature wear arising from the dragging of the playing foot, which occurs very frequently when playing tennis.

Figure 2:
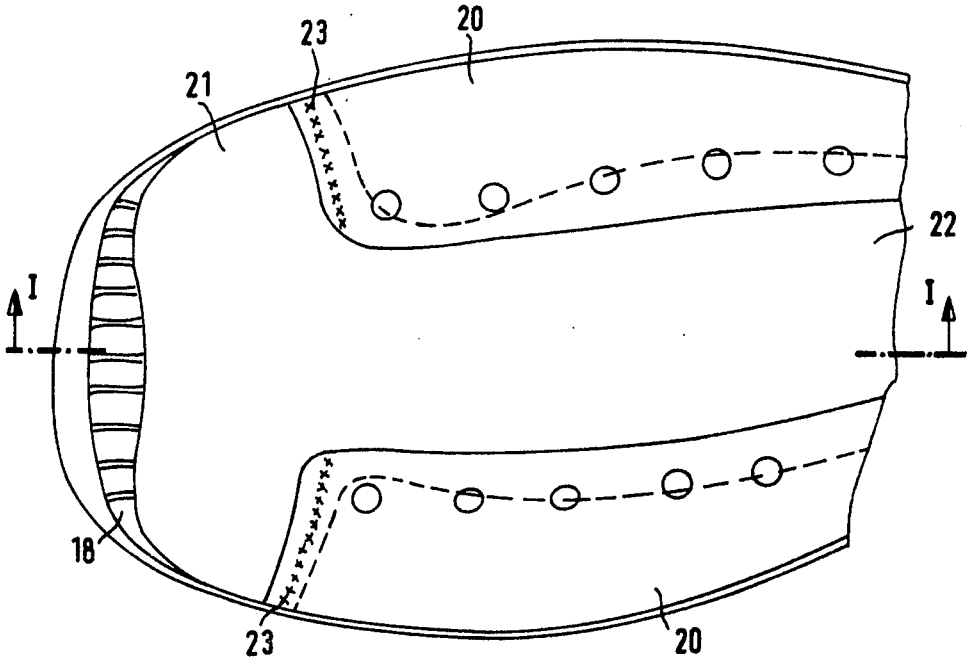
FIG. 2 shows a top view of the front part of the shoe according to FIG. 1.

As may be seen in particular from FIG. 2, the tennis shoe shown is made with the Derby cut, that is to say its upper has lateral portions 20, with eyelets for laces, which are stitched at 23 to a separate toe portion 21 which is itself continued into a tongue 22. This cut of the upper makes it possible to place the lacing relatively far forward without having to take account of thhe flexibility of the toe portion 21, and this, in conjunction with the choice of material, explained below, for the toe portions 21 results in particularly good shape retention of this toe portion even after a long period of use.

The toe portion 21 is made, integrally with the tongue 22, of a highly air-permeable fabric, for example a nylon net or a net fabric, in which two outer layers 21' are joined, and spaced apart, by upright loops 21". The toe portion 21 is stitched to the insole 2 at 24 and is perforated at 25, that is to say at the mouths of the front venting channels 15. The net material of which the toe portion 21 and tongue 22 are made can, if required, be faced, on the inside, with a layer of lining which increases the foot comfort but is of course also highly air-permeable.

In use, and as shown in dotted lines in FIG. 1, the foot of a user is tightly fitted inside the shoe, due to the firm lacing of the upper portions 20, both at these upper portions and at the tongue 22 and in the region of the ball of the foot. Despite this, the toes will constantly execute movements during the rolling movement of the foot, which will lead to air being introduced and expelled through the venting channels 8 through the sole bottom. Since the venting channels 8 terminate in the hollows 11 of the toes, the channels are always open so that air can flow through them in any phase of the movement of the foot. The same applies to the front venting channels 15, since these also terminate in regions which cannot be sealed by the foot. As is known, it is at most the big toe (and this only if the shoe is tight) which rests against the front end of the shoe, whilst there is a cavity extending all the way round to the small toe. The venting channels 8 and 15, in conjunction with the air-permeable toe portion 21, therefore provide venting over the interior of the shoe as a result of which the moisture generated can be transported away by the air introduced and expelled, that is to say by an air stream. Due to the tongue 22, which is also air-permeable, moisture generated can evaporate and the foot is kept cool at the instep.

Obviously, further venting measures which are in themselves known can be provided, for instance in the waist of the upper, in addition to the venting measures described above.

Although particularly useful for tennis shoes, the invention is applicable to other types of sports shoe, mainly, however, those which are in the main used indoors. Adjacent the stitching 23 or slightly in front of this stitching, the rim 4 of the sole 1 may have, for example over a length of 1 cm from the join with the sole, a reduced wall thickness so as to form "creasing zones" which assist the rolling movement of the foot and prevent the frequently observed tearing of the shell rim 4 from the upper at this point.

A further possibility of venting in the waist region is provided if the part of the upper onto which the three strips which form the applicant's trade mark are stitched, is also manufactured of the same permeable fabric as the toe portion 21.

The sports show can be provided either with a leather upper or with a linen upper.

In addition it is possible, in place of the scuffing bead, to stitch onto the shoe strips of for instance leather, which run over the toe portion 21 and which, for example, run in backwards under the upper portions 20.

I claim:

1. A sports shoe having a toe end and a flexible plastics outsole, venting channels extending through said outsole between the exterior and interior of the sole and orifices to said venting channels at the interior of the shoe, wherein said channels and orifices are arranged on an imaginary line which extends beneath the hollows of the toes of the wearer, between the ball of the foot and the balls of the toes of the wearer.

2. A sports shoe as claimed in claim 1 including sieve inserts in said venting channels.

3. A sports shoe as claimed in claim 1 wherein there are four venting channels.

4. A sports shoe as claimed in claim 1 including an insole and an upwardly extending rim of the sole at the toe end of the shoe and further venting channels which extend through said rim, interior orifices of said venting channels being above said insole.

5. A sports shoe as claimed in claim 4 wherein said further venting channels are inclined upwardly from the exterior of the shoe towards the interior.

6. A sports shoe as claimed in claim 4 including beads surrounding exterior orifices to said further venting channels.

7. A sports shoe as claimed in claim 4 including downwardly extending lips partially covering and spaced a small distance forwardly of exterior orifices of said further venting channels.

8. A sports shoe as claimed in claim 1 having an upper, a toe portion thereof and a tongue, said toe portion and tongue each consisting of a highly air-permeable fabric.

9. A sports shoe as claimed in claim 8 wherein the toe portion and tongue are integral with one another.

10. A sports shoe as claimed in claim 8 wherein the fabric is a net fabric which may have a highly permeable lining.

11. A sports shoe as claimed in claim 1 having a portion of the sole in which the venting channels are provided, and a remaining part of the sole, said portion being formed as a moulded part of greater scuffing resistance than the remaining part and being joined to the remaining part.

12. A sports shoe as claimed in claim 11 wherein the moulded part extends beneath the ball of the foot of a wearer, and including a tapering rear part to said moulded part by which it is joined to said remaining part.

13. A sports shoe as claimed in claim 1, having an upper which is cut in the Derby cut, side portions of the upper extending to about 4 cms from the front end of the shoe.

14. A sports shoe as claimed in claim 1 wherein said venting orifices having diameters of at least 3 mm.

* * * * *